62-6

11/19/85 OR 4,553,398

United States Patent [19]

Young

[11] Patent Number: 4,553,398

[45] Date of Patent: Nov. 19, 1985

[54] LINEAR MOTOR COMPRESSOR WITH PRESSURE STABILIZATION PORTS FOR USE IN REFRIGERATION SYSTEMS

[75] Inventor: Niels O. Young, Free Union, Va.

[73] Assignee: Helix Technology Corporation, Waltham, Mass.

[21] Appl. No.: 576,865

[22] Filed: Feb. 3, 1984

[51] Int. Cl.[4] ..... F25B 9/00; F04B 7/04

[52] U.S. Cl. ..... 62/6; 417/340; 417/496

[58] Field of Search ..... 417/496, 437, 340; 62/6

[56] References Cited

U.S. PATENT DOCUMENTS

| | | | |
|---|---|---|---|
| 1,198,502 | 9/1916 | Wishart | 417/496 |
| 2,588,261 | 3/1952 | Magdeburger | 417/496 |
| 2,685,838 | 8/1954 | Weinfurt | 417/340 |
| 3,218,815 | 11/1965 | Chellis et al. | 62/6 |
| 3,688,512 | 9/1972 | Prast | 62/6 |
| 3,828,558 | 8/1974 | Beale | 60/520 |
| 4,058,382 | 1/1977 | Mulder | 62/6 |
| 4,458,495 | 7/1984 | Beale | 62/6 |

*Primary Examiner*—William L. Freeh

*Attorney, Agent, or Firm*—Hamilton, Brook, Smith & Reynolds

[57] ABSTRACT

A pressure stabilization system for a linear compressor 20 piston 24 in which a check valve 68 and passages 72, 64 within the piston permit communication between a compressor work space and a non-working volume of gas 54 through an orifice 66 in the piston cylinder 30. The check valve and ports allow momentary fluid communication between the dead space volume 54 and the working volume 26. The fluid communication serves to stabilize working volume pressure and counteract the effects of gas leakage about the piston 24 and into the dead volume 54. This fluid communication only occurs when dead volume pressure is greater than working volume pressure and port 66 and 64 are axially aligned.

8 Claims, 5 Drawing Figures

LINEAR MOTOR COMPRESSOR WITH PRESSURE STABILIZATION PORTS FOR USE IN REFRIGERATION SYSTEMS

DESCRIPTION

1. Field of the Invention

This invention relates to cryogenic refrigerators such as split Stirling cryogenic refrigerators. In particular, it relates to refrigeration systems having displacers and/or compressors driven by linear motors.

2. Background

Conventional split Stirling refrigerators such as shown in FIG. 5 usually include a reciprocating compressor 10 and a displacer 11 in a cold finger 12 removed from that compressor. The piston 13 of the compressor is mechanically driven to provide a nearly sinusoidal pressure variation in a pressurized refrigeration gas such as helium. This pressure variation is transmitted through a supply line 14 to the displacer in the cold finger.

Typically, an electric motor drives the compressor piston 13 through a crank shaft which is rotatably secured to the piston. The movement of the compressor piston causes pressure in a working volume 14, 15, 16, 17, 18 to rise from a minimum pressure to a maximum pressure and, thus, warm the working volume of gas. Heat from the warmed gas is transferred to the environment so that the compression at the warm end 16 of the cold finger is nearly isothermal. The high pressure creates a pressure differential across the displacer in the cold finger which, when retarding forces are overcome, is free to move within the cold finger. With the movement of the displacer, high pressure working gas at about ambient temperature is forced through a regenerator in the space 17 and into a cold space 18. The regenerator absorbs heat from the flowing pressurized refrigerant gas and thus reduces the temperature of the gas.

As the compressor piston reverses direction and begins to expand the volume of gas in the working volume, the high pressure helium in the cold space 18 is cooled even further. It is this cooling at the cold end of the displacer which provides refrigeration for maintaining a time average temperature gradient of over 200° Kelvin over the length of the regenerator.

At some point the decrease in pressure caused by the expanding movement of the piston drops sufficiently to overcome the retarding forces on the displacer in the cold finger. This causes the displacer to be returned to its starting position. Cool gas from the cold end of the cold finger is driven once again through the regenerator and extracts heat therefrom.

More recently, refrigerators have been proposed and manufactured that depend on linear motor systems to control the movement of the piston or pistons in the compressor and that of the displacer. These systems also use clearance seals between hard ceramic pistons and cylinder liners. An example is disclosed in U.S. patent application Ser. No. 458,718 filed by Niels Young on Jan. 17, 1983.

A goal in the use of these linear motor refrigerators is to produce a refrigerator capable of extended service with little or no maintenance.

DISCLOSURE OF THE INVENTION

The invention comprises a pressure stabilization system for a piston of a linear compressor. The linear compressor piston is positioned for axial movement within a sleeve for the purpose of compressing and expanding refrigerant gas in a compressor work space. A displacer is in fluid communication with the compressor work space.

The pressure stabilization system comprises a fluid passage in the compressor which permits momentary fluid communication between a non-working volume of refrigerant gas and the compressor work space during a predetermined portion of the compressor's cycle. This momentary fluid communication occurs during the expansion of gas in the work space as the piston is withdrawn and serves to stabilize the average pressure of refrigerant gas in the work space during compressor operation.

In a preferred embodiment of the invention, the fluid passage is positioned within the compressor piston. The fluid passage is positioned for momentary communication with a port in the piston housing or sleeve during piston operation. Within the fluid passage a check valve allows fluid communication only in one direction, towards the work space, when the work space pressure is below that of the nonworking volume of gas. This fluid communication counteracts the effects of gas leakage from the compressor work space due to causes such as gas bearings. The check valve also prevents loss of working volume gas from the compressor work space during the compression phase of the compressor's cycle.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
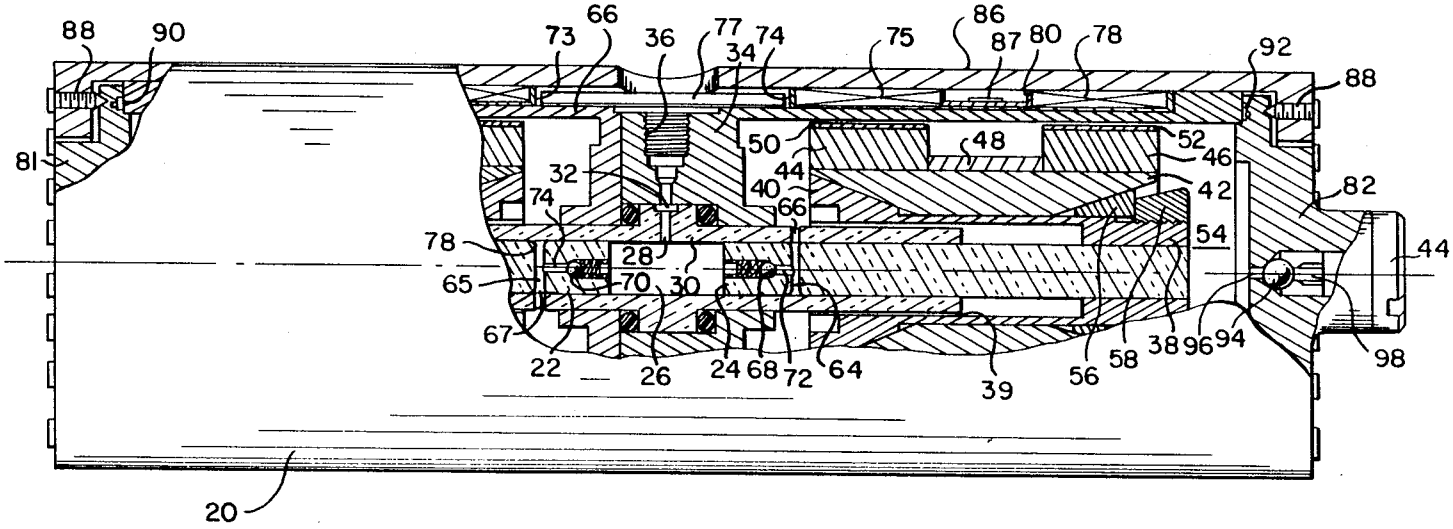
FIG. 1 is a side view of a linear compressor in a split Stirling refrigerator embodying this invention, partially in section to show the linear motor assembly and refrigerant gas passages.
Figure 5:
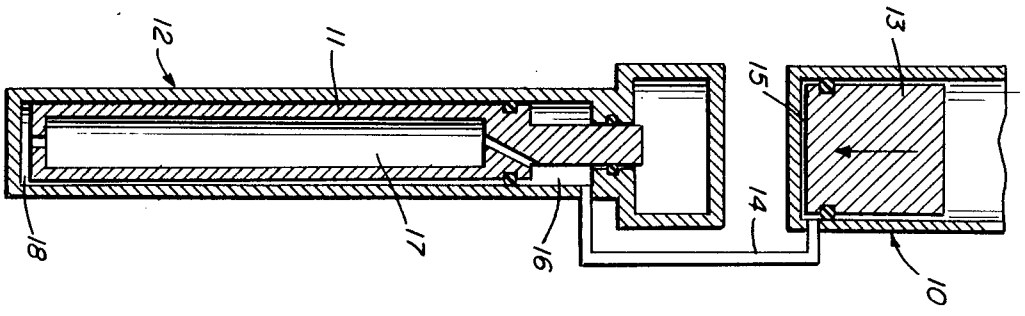
FIG. 5 PRIOR ART
FIG. 5 is a schematic illustration of a conventional Stirling cycle refrigerator.

A preferred linear motor compressor is illustrated in FIG. 1. This compressor comprises dual reciprocating piston elements 22 and 24 which when driven toward each other, compress helium gas in compressor head space 26. The compressed gas then passes through a side port 28 in a compression chamber cylinder 30 to an outer annulus 32 in that cylinder. The gas from the annulus 32 passes through an outer housing 34 to a tube fitting hole 36. A tube (not shown) joined at the fitting hole 36 serves to deliver the gas to a cold finger of a split Stirling refrigerator in which a displacer is housed (FIG. 5).

Preferably, pistons 22 and 24 and compression chamber 30 are of cermet, ceramic or some other hard, low friction material. The pistons and chamber cylinder are close fitting to provide a clearance seal therebetween.

The pistons 22 and 24 serve as the sole mechanical support for respective armatures of the linear drive motors. Identical motors drive the two pistons. The right hand motor is shown in detail in FIG. 1, and its armature is shown in the exploded view of FIG. 2.

A sleeve 38 is joined to the piston 24 at its far end from the compressor head space 26. Sleeve 38 has an inner clearance 39 such that it is free to shuttle back and forth along the compressor chamber 30 without contacting it. The sleeve 38 has a tapered flange 40 at its left end. An expanding collar 42, placed on the sleeve 38 from the right, abuts the flange 40. The expanding collar 42 is an inner flux return that has a high magnetic permeability. It also supports two sets of radial permanent magnets 44, 46 separated by a spacer 48. The six magnets 49 in each set of permanent magnets 46 are retained by magnet retaining rings 50 and 52.

Figure 2:
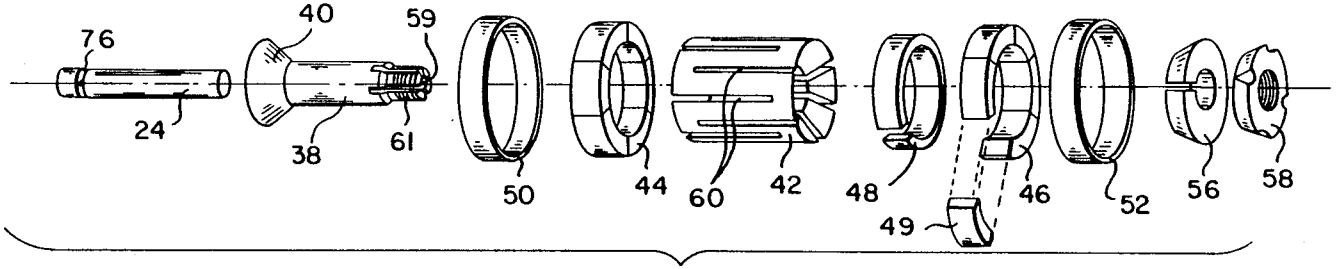
FIG. 2 is an exploded view of the armature assembly of the compressor shown in FIG. 1.

Although magnets 44 and 46 are shown closely packed in FIG. 2, they are preferably dimensioned such that, when placed about the expanding collar 42, spaces remain between the magnets 49. With that arrangement helium gas in the dead space 54 of the compressor is free to flow between the individual magnets 49 as the drive motor armature and compressor piston assembly shuttles back and forth.

Dissimilarities in the magnetic elements may cause the magnetic axis of the group of magnets to be offset from the mechanical axis of the piston 24. Such an offset of the magnetic axis from the mechanical axis would result in radial forces on the piston 24 which would tend to bind the piston within the cylinder 30. The magnetic axis can be made the same as the mechanical axis by adjusting the relative angular position of the magnets about the expanding sleeve 42 thus utilizing the clearance spaces between the magnets 49. The elimination of radial forces is particularly important where the sole mechanical support for the armature is the piston 24 within the cylinder 30.

As shown in FIG. 2, the expanding collar 42 has slots 60 which allow for expansion. To permanently fix the magnets 44 and 46 in position on the armature, a tapered collet 56 is wedged between the expanding collar 42 and the tapered sleeve 38 by a nut 58. As the nut 58 is tightened on the sleeve 38 the expanding collar is pressed outward by the tapered flange 40 and the collet 56. The expanding collar 42 in turn presses the magnets 44 and 46 against the magnetic retaining rings 50 and 52.

The tapered sleeve 38 has slots 59 formed in the end thereof so that as the collet presses outward against the expanding collar 42 it also presses inward and compresses the sleeve 38 to form a tight joint between the sleeve and the piston 24. The use of expansion and compression joints in the armature avoids the need for any epoxy or any other adhesive which might contaminate the helium gas.

The armature assembly just described is operated through the use of electromagnetic coils positioned within the housing 86 (FIG. 1). Two coils 75 and 78 are used to position piston 24. Similarly, two coils (73 and another not shown) are used to position piston 22. A spacer 80 separates the two coils. Positioned within the spacer is a Hall effect sensor 87 which is used to determine piston position. The coils 75, 78 of the right hand armature are separated from those of the left hand armature by spacer 77. Spacer 77 is split to allow positioning of a tube fitting in hole 36.

The spacers, position sensor and coils are all arranged about the periphery of housing 34. Housing 34 and similar left hand housing 66 are sealed against end caps 82 and 81 by screws 88. These screws press the end caps 81, 82 tightly against indium seals 90 and 92 to tightly seal the armatures, pistons and their surrounding helium environ- ment.

The end cap 82 includes an assembly which permits easy charging of the compressor with helium gas through port 96. During compressor operation, however, a ball 94 closes port 96 in the end cover 82. The ball is retained against the port by a retainer screw 98 and is protected from contamination by plug 44.

The armature assembly and linear motor described above is also described in detail in copending U.S. patent application Ser. No. 458,718, filed Jan. 17, 1983. When such linear motors with clearance seals are utilized in small refrigeration systems, gas pressure in the head space 26 can require adjustment due to gas leakage past the compressor pistons. The invention described herein improves the system in a manner which lessens the need for such adjustment while improving compressor efficiency.

Figure 3:
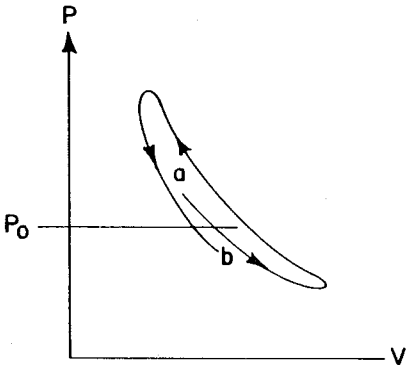
FIG. 3 is a pressure-volume plot of a conventional linear motor piston.

FIG. 3 is a pressure-volume graph of the operation of a linear motor piston of the type described above. The curve traced out makes no allowance for pressure stabilization ports embodying this invention as described herein.

The pistons 24, 26 are sealed within the cylinder 30 by close fit clearance seals. The property of such seals is that gas flow within the seal is confined to a small viscous or boundary layer flow. Blow-by of this gas flow may tend to deplete the head space 26 of gas, since more gas may leave the pressurized volume 26 in the work space than enters it from the non-working volume of fluid, or dead space volume 54.

Depletion of headspace gas can also occur through causes other than simply blow-by. The time average headspace pressure drops during initial cooldown of an expander, and this gas must be replenished. Also, if gas bearings are used upon the piston, there is a time average flow outward from the headspace as a result; this is because the gas bearings lift the piston by using the compressed gas provided from the compressor headspace.

Depletion of head space gas tends to result in a mean working volume pressure below that of the dead space pressure. This requires the linear motor to work harder in one direction than the other and therefore be less efficient. The most efficient operation of the linear motor occurs when about equal work is expended in both the expansion and the compression parts of the cycle.

Another result of this gas loss is that the pressure-volume curve of a linear motor piston does not close (i.e. repeat identically). In FIG. 3 the upward pointing arrow represents compression of the working volume 26 while the downward pointing arrows represent expansion of the working volume. Note that the curve adjacent to point "a" near the beginning of an expansion cycle represents a higher pressure of gas than the curve near point "b" at the end of a cycle. As the piston continues to cycle the compression volume 26 loses gas until it stabilizes at some lower pressure which results in equal blow-by in forward and reverse directions. Operating the working volume of gas at a lower average pressure results in a decrease in efficiency of the compressor and therefore the refrigeration system.

Reducing the amount of gas in the working volume of refrigerant gas reduces the pressure of the helium gas at the displacer which results in less effective cooling of the cold finger. The temperature at the cold end of the cold finger would therefore rise. Thus, such a linear compressor would need recharging and maintenance when the head space gas volume declined below the minimum required for efficient refrigerator operation.

Returning now to FIG. 1, the pistons disclosed herein are equipped with a pressure stabilization system. During the compressor's expansion cycle, ducts 64 and 65 in each piston can momentarily communicate with dead space volume 54 through inlet ports 66 and 67. Preferably ducts 64 and 65 are in alignment with ports 66 and 67 at about midstroke. When the ports and ducts are aligned in the expansion stroke and the pressure in backspace volume 54 is higher than that in the compression chamber 26, check valves 68 and 70 open to allow centrally located piston ports 72 and 74 to communicate with the compression volume. This allows the work space pressure to rise to the pressure of the dead space gas.

An annular depression 76 (FIG. 2) formed on the piston allows gas pressure in the pressure stabilization system to be equalized about the piston to prevent chafing of the piston in the cylinder sleeve 30 during gas release. Chamfers 78 are provided on ports 65, 67 in order to reduce manufacturing tolerances and to promote satisfactory operation of the pressure stabilization system with mass manufactured parts.

Figure 4:
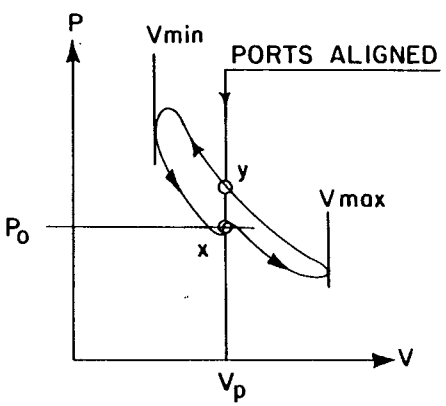
FIG. 4 is a pressure- volume plot of a linear motor piston incorporating principles of this invention.

FIG. 4 is a pressure-volume curve of a system with the pressure stabilization described. Starting from point X at pressure Po (dead space pressure) it can be seen that the pressure-volume curve is much the same as that shown in FIG. 3. However, when the compression volume increases during the expansion cycle, indicated by the downward sloping arrows, the pressure stabilization ports momentarily open at point "x". At this point the ports are aligned and gas is injected through ports 66 and 67 from the dead space volume into the compression volume thus returning the compression cycle to its original starting pressure, Po at volume Vp.

The check valves 68 and 70 are an integral part of the pressurization system without which system efficiency would be lost, particularly in systems with small volumes of gas.

Referring now to both FIGS. 1 and 4, it can be seen that the pressure stabilization ports also align during the compression part of the cycle, indicated by the upwardly pointing arrow in FIG. 4. Check valves 68 and 70 serve to prevent venting of the compression volume 26 into the back space 54. Such venting would return the gas pressure in the head space from that at point Y to the back space pressure, Po. If such venting was allowed, and the pressure in the compression volume 26 were reduced (to Po) it would collapse the curve which represents the Stirling thermodynamic cycle.

The short burst of gas allowed into the compression volume serves to anchor the point X. Therefore, the maximum and minimum volumes of the compression chamber 26 are also fixed. The limits of the compressor piston excursion, the minimum and the maximum volume, are now solely dependent on the input power to the compressor and the losses due to friction. A benefit of such a system which fixes the pressure-volume curve of the compressor is the that gas forces themselves can be utilized as a method of controlling the limits of piston excursion. Mechanical stops and electrical controls which might otherwise be required to maintain piston position can be reduced and in some cases may be completely eliminated. If gas forces are carefully controlled, the spring force of the gas will always be sufficient to limit piston movement. A further advantage of the pressurization system is that by anchoring point X at Vp on the pressure-volume curve the system becomes substantially independent of outside changes in cycle pressure, for example, those changes resulting from changes in the temperature of the environment surrounding the system.

This system as described automatically maintains the average head space pressure in the linear compressor at or above that of the dead space 54 during linear compressor operation. Maintaining piston head space 26 pressure has several advantages. Since gas pressure in cavity 26 is relatively high compared to dead space 54 the chances that pistons 22 and 24 will hit each other during compression and damage the compressor is minimized. Further, since point Po (the dead space pressure) is located centrally in the system's cycle (FIG. 4), the motor force applied to the pistons during compression and expansion of the refrigerant in the head space is about equal and is minimized. If the pistons had a high gas force acting upon them, for example, a higher dead space pressure than head space pressure during most of the cycle, greater linear motor force would be required. Greater motor force, in addition to requiring greater electrical energy, applies larger forces on the pistons which increases the likelihood of wear or scoring on the cylinder's 30 inner surface or sleeve.

It has therefore been shown how the above described pressure stabilization system acts to both improve linear compressor efficiency and reduce the need for compressor maintenance. While the invention has been particularly shown and described with reference to preferred embodiments thereof, it will be understood by those skilled in the art that various changes in form and details may be made without departing from the spirit and scope of the invention as defined in the appended claims.

I claim:

1. A cryogenic refrigerator comprising:

a compressor comprising a piston in a sleeve for compressing and expanding refrigerant gas in a compressor work space which is a portion of a closed working volume;

a displacer in the closed working volume in fluid communication with said compressor work space; and a fluid passage in the compressor which permits momentary fluid communication between a second closed volume of refrigerant gas and said compressor work space only at a predetermined portion of piston stroke during the expansion of gas in said work space as the piston is withdrawn to stabilize the pressure of the refrigerant gas in the work space during compressor operation.

2. The cryogenic refrigerator of claim 1 wherein the fluid passage is positioned within the compressor piston and a fluid inlet port is positioned in said piston sleeve to communicate with said fluid passage.

3. The cryogenic refrigerator of claim 2 wherein the fluid passage further comprises a check valve.

4. The cryogenic refrigerator of claim 2 further comprising an annular depression on the surface of the piston at the same axial location as said fluid passage's inlet port, said annular depression providing pressure equalization about the piston shaft.

5. In a cryogenic refrigerator comprising a closed volume of gaseous working fluid which is alternately compressed and expanded at a compressor head space by a compressor piston and cyclically displaced by a displacer in fluid communication with the compressor head space to cool a portion of the closed volume of working fluid to cryogenic temperatures, the refrigerator further comprising:

a fluid passage within the compressor piston for providing automatic momentary fluid communication of a closed non-working volume of fluid with the closed volume of working fluid only at a predetermined portion of the piston stroke during working volume expansion in the refrigeration compressor.

6. A cryogenic refrigerator as claimed in claim 5 further comprising a check valve positioned within the fluid passage of said stabilization system to prevent fluid communication of the working volume with the non-working gas volume during gas compression.

7. A method of stabilizing pressure in a closed work space of a refrigerator having a displacer for displacing gas in the work space through a regenerator as the gas is compressed and expanded by a compressor piston comprising the steps of:

a. compressing a working fluid in a closed work space with the compressor piston;
b. expanding the working fluid in the closed work space with the piston;
c. communicating gas from a closed non-working backspace volume to the closed work space only at a predetermined portion of piston stroke during expansion of fluid in the closed work space; and
d. sealing said closed backspace volume from communication with the closed work space during compression of the working fluid.

8. The method of stabilizing pressure in a linear compressor recited in claim 7 wherein the method of sealing the back space during compression comprises a check valve.

* * * * *